US005149497A

United States Patent [19]

McKee et al.

[11] Patent Number: 5,149,497

[45] Date of Patent: * Sep. 22, 1992

[54] OXIDATION RESISTANT COATINGS OF GAMMA TITANIUM ALUMINUM ALLOYS MODIFIED BY CHROMIUM AND TANTALUM

[75] Inventors: Douglas W. McKee, Burnt Hills; Shyh-Chin Huang, Latham, both of N.Y.

[73] Assignee: General Electric Company, Schenectady, N.Y.

[ * ] Notice: The portion of the term of this patent subsequent to Jul. 2, 2008 has been disclaimed.

[21] Appl. No.: 713,494

[22] Filed: Jun. 12, 1991

[51] Int. Cl.[5] ..... C22C 14/00; C21D 1/00

[52] U.S. Cl. ..... 420/418; 420/417; 148/421

[58] Field of Search ..... 420/418, 417; 148/421

[56] References Cited

U.S. PATENT DOCUMENTS 4,842,817 6/1989 Huang et al. ..... 420/418
4,842,819 6/1989 Huang et al. ..... 420/418
4,879,092 11/1989 Huang ..... 420/418
5,028,491 7/1991 Huang et al. ..... 148/421

FOREIGN PATENT DOCUMENTS 0406638 1/1991 European Pat. Off. .

OTHER PUBLICATIONS

Lipsitt, H. A., Mat. Res. Soc. Symp. Proc. #39, 1985, pp. 353-364.

*Primary Examiner*—Upendra Roy
*Attorney, Agent, or Firm*—Paul E. Rochford; James C. Davis, Jr.; James Magee, Jr.

[57] ABSTRACT

It has been found that a titanium aluminide modified with chromium and tantalum in the rates of about $Ti\text{-}Al_{46-56}Cr_{1-4}Ta_{4-8}$ has a remarkable and unique antioxidation capability. Because of this unique antioxidation property, this aluminide can be used as a protective coating on other aluminides as well as on the surfaces of other bodies needing atmospheric protection.

4 Claims, 5 Drawing Sheets

OXIDATION RESISTANT COATINGS OF GAMMA TITANIUM ALUMINUM ALLOYS MODIFIED BY CHROMIUM AND TANTALUM

CROSS REFERENCE TO RELATED APPLICATIONS

The subject application relates to copending applications as follows:

U.S. Pat. application Ser. Nos. 07/373,078, filed June 29, 1989; and 07/375,074, filed July 3, 1989

The application for Serial No. 07/375,074 is particularly relevant.

BACKGROUND OF THE INVENTION

The present invention relates generally to oxidation resistant coatings formed of alloys of titanium and aluminum. More particularly, it relates to such coatings formed of alloys of titanium and aluminum which have been modified both with respect to stoichiometric ratio and with respect to chromium and tantalum addition.

It is known that as aluminum is added to titanium metal in greater and greater proportions the crystal form of the resultant titanium aluminum composition changes. Small percentages of aluminum go into solid solution in titanium and the crystal form remains that of alpha titanium. At higher concentrations of aluminum (including about 25 to 35 atomic %) an intermetallic compound $Ti_3Al$ is formed. The $Ti_3Al$ has an ordered hexagonal crystal form called alpha-2. At still higher concentrations of aluminum (including the range of 50 to 60 atomic % aluminum) another intermetallic compound TiAl, is formed having an ordered tetragonal crystal form called gamma. Coatings formed of the gamma compound, as modified, is the subject matter of the present invention. Also, the invention concerns titanium aluminide alloy structures which are coated by gamma TiAl modified by chromium and tantalum.

The alloy of titanium and aluminum having a gamma crystal form, and a stoichiometric ratio of approximately one, is an intermetallic compound having a high modulus, a low density, a high thermal conductivity, favorable, although not extraordinary, oxidation resistance, and good creep resistance.

The relationship between the modulus and temperature for TiAl compounds to other alloys of titanium and in relation to nickel base superalloys is shown in FIG. 5. As is evident from the figure, the TiAl has the best modulus of any of the titanium alloys. Not only is the TiAl modulus higher at higher temperature but the rate of decrease of the modulus with temperature increase is lower for TiAl than for the other titanium alloys. Moreover, the TiAl retains a useful modulus at temperatures above those at which the other titanium alloys become useless. Alloys which are based on the TiAl intermetallic compound are attractive lightweight materials for use where high modulus is required at high temperatures and where good, although not extraordinary, environmental protection is also required.

One of the characteristics of TiAl which limits its actual application to such uses is a brittleness which is found to occur at room temperature. Also, the strength of the intermetallic compound at room temperature can use improvement before the TiAl intermetallic compound can be exploited in certain structural component applications. Improvements of the gamma TiAl intermetallic compound to enhance creep resistance as well as to enhance ductility and/or strength at room temperature are very highly desirable in order to permit use of the compositions at the higher temperatures for which they are suitable.

With potential benefits of use at light weight and at high temperatures, what is most desired in the TiAl compositions which are to be used is a combination of strength and ductility at room temperature. A minimum ductility of over one percent is acceptable for some applications of the metal composition but higher ductilities are much more desirable. A minimum strength for a composition to be useful is about 50 ksi or about 350 MPa. However, materials having this level of strength are of marginal utility for certain applications and higher strengths are often preferred for some applications.

The stoichiometric ratio of gamma TiAl compounds can vary over a range without altering the crystal structure. The aluminum content can vary from about 50 to about 60 atom percent. The properties of gamma TiAl compositions are, however, subject to every, significant as a result of relatively small changes of one percent or more in the stoichiometric ratio of the titanium and aluminum ingredients. Also, the properties are similarly significantly affected by the addition of relatively similar small amounts of ternary elements.

I have now discovered that further improvements can be made in the gamma TiAl intermetallic compounds and particularly in oxidation resistance, by incorporating therein a combination of additive elements so that the composition not only contains a ternary additive element but also a quaternary additive element.

Furthermore, I have discovered that the composition including the quaternary additive element has a uniquely desirable combination of properties which include a substantially improved strength, a desirably high ductility, a significantly improved creep resistance, and a remarkably valuable oxidation resistance. In fact, the oxidation resistance is so high that the material can be used as a coating layer on other titanium aluminide alloys of lower oxidation resistance.

PRIOR ART

There is extensive literature on the compositions of titanium aluminum including the $Ti_3Al$ intermetallic compound, the TiAl intermetallic compounds and the $Ti_3Al$ intermetallic compound. A patent, U.S. Pat. No. 4,294,615, entitled Titanium Alloys of the TiAl Type contains an extensive discussion of the titanium aluminide type alloys including the TiAl intermetallic compound. As pointed out in the patent in column 1, starting at line 50, in discussing TiAl's advantages and disadvantages relative to $Ti_3Al$:

> "It should be evident that the TiAl gamma alloy system has the potential for being lighter inasmuch as it contains more aluminum. Laboratory work in the 1950's indicated that titanium aluminide alloys had the potential for high temperature use to about 1000° C. But subsequent engineering experience with such alloys was that, while they had the requisite high temperature strength, they had little or no ductility at room and moderate temperatures, i.e., from 20° C. to 550° C. Materials which are too brittle cannot be readily fabricated, nor can they withstand infrequent but inevitable minor service damage without cracking and subsequent failure.

They are not useful engineering materials to replace other base alloys."

It is known that the alloy system TiAl is substantially different from $Ti_3Al$ (as well as from solid solution alloys of Ti) although both TiAl and $Ti_3Al$ are basically ordered titanium aluminum intermetallic compounds. As the '615 patent points out at the bottom of column 1:

> "Those well skilled recognize that there is a substantial difference between the two ordered phases. Alloying and transformational behavior of $Ti_3Al$ resemble those of titanium, as the hexagonal crystal structures are very similar. However, the compound TiAl has a tetragonal arrangement of atoms and thus rather different alloying characteristics. Such a distinction is often not recognized in the earlier literature."

The '615 patent does describe the alloying of TiAl with vanadium and carbon to achieve some property improvements in the resulting alloy. In Table 2 of the '615 patent, two TiAl compositions containing tungsten are disclosed. However, there is no disclosure in the '615 patent of any compositions TiAl containing chromium or tantalum. There is, accordingly, no disclosure of any TiAl composition containing a combination of chromium and tantalum.

A number of technical publications dealing with the titanium aluminum compounds as well as with the characteristics of these compounds are as follows:

1. E.S. Bumps, H.D. Kessler, and M. Hansen, "Titanium-Aluminum System", *Journal of Metals*, June 1952, pp. 609-614, TRANSACTIONS AIME, Vol. 194.
2 H.R. Ogden, D.J. Maykuth, W.L. Finlay,and R.I. Jaffee, Mechanical Properties of High Purity Ti-Al Alloys", *Journal of Metals*, February 1953, pp. 267-272, TRANSACTIONS AIME, Vol. 197.
3. Joseph B. McAndrew, and H.D. Kessler, "Ti-36 Pct Al as a Base for High Temperature Alloys", *Journal of Metals*, Oct. 1956, pp. 1348-1353, TRANSACTIONS AIME, Vol. 206.

This latter paper discloses on page 1353 a composition of titanium-35 weight percent aluminum and 7 weight percent tantalum. On an atomic percent scale this is equivalent to $Ti_{47.5}Al_{51}$Tahd 5. This composition is stated to have an ultimate tensile strength of 76,060 psi and a ductility of about 1.5% and is discussed further below.

A discussion of oxidative influences and the effect of additives, including tantalum, on oxidation is contained starting on page 1350 of the Journal of Metals, October 1956, Transactions AIME.

4. Patric L. Martin, Magdan G. Mendiratta, and Harry A. Lispitt, "*Creep Deformation of TiAl and TiAl +Alloys*", Metallurgical Transactions A, Volume 14A (October 1983) pp. 2171-2174.
5. P.L. Martin, H.A. Lispitt, N.T. Nuhfer, and J.C. Williams, "*The Effects of Alloying on the Microstructure and Properties of* $Ti_3Al$ and TiAl", Titanium 80, (Published by American Society for Metals, Warrendale, PA), Vol. 2, pp. 1245-1254 .
6. R.A. Perkins, K.T. Chiang, and G.H. Meier, "*Formulation of Alumina on Ti-Al Alloys*", Scripta METALLURGICA, Vol. 21 (1987) pages 1505-1510.
7. Tokuzo Tsujimoto, "*Research, Development, and Prospects of TiAl Intermetallic Compound Alloys*", Titanium and Zirconium, Vol. 33, No. 3, 159 (July 1985) pp. 1-19.
8. H.A Lipsitt, "Titanium Aluminites—An Overview", Mat.Res.Soc. Symposium Proc., Materials Research Society, Vol. 39 (1985) pp. 351-364.
9. S.H. Whang et al., "*Effect of Rapid Solidification in* $Ll_0$TiAl Compound Alloys", ASM Symposium Proceedings on Enhanced Properties in Struc.Metals Via Rapid Solidification, Materials Week (October 1986) pp. 1-7.
10. Izvestiya Akademii Nauk SSSR, Metally. No. 3 (1984) pp. 164-168.

U.S. Pat. No. 4,661,316 to Hashianoto teaches doping of TiAl with 0.1 to 5.0 weight percent of manganese, as well as doping TiAl with combinations of other elements with manganese. The Hashianoto patent does not teach the doping of TiAl with chromium or other combinations of elements including chromium and particularly not a combination of chromium with tantalum.

U.S. Pat. No. 3,203,794 to Jaffee discloses a TiAl composition containing silicon and a separate TiAl composition containing chromium.

Japanese Kokai Patent No. Hei (1989) 298127 describes various titanium aluminide compositions containing separate additions of chromium and niobium as well as other additives.

Canadian Patent 62,884 to Jaffee discloses a composition containing chromium in TiAl in Table 1 of the patent. Jafee also discloses a separate composition in Table 1 containing tantalum in TiAl as well as about 26 other TiAl compositions containing additives in TiAl. There is no disclosure in the Jaffee Canadian patent of any TiAl compositions containing combinations of elements with chromium or combinations of elements with tantalum. There is particularly no disclosure or hint or suggestion of a TiAl compositions containing a combination of chromium and tantalum.

A number of commonly owned patents relating to titanium aluminides have issued. These include U.S. Pat. Nos. 4,836,983; 4,842,817; 4,842,819; 4,842,820; 4,857,268; 4,879,092; 4,897,127; 4,902,474, 4,923,534; and U.S. Pat. No. No. 4,842,817 to S.C. Huang and M.F.X. Gigliotti. U.S. Pat. Nos. 4,842,819 and 4,842,817 concern separate compositions containing chromium and tantalum respectively. Some of these patents include data concerning oxidation resistance of the compositions but none are as outstanding in oxidation resistance as to permit their use as coatings as effective as the coatings of this application.

With regard to the oxidation resistance of the the titanium aluminum compositions, it is recognized that titanium itself is very reactive with oxygen. What results from this reaction is the formation of a spalling oxide scale and the embrittlement of the metal itself. It is recognized that this mode of oxidation is one of the main factors that limits the use of titanium alloys at elevated temperatures. It is recognized that protective coatings which serve as oxygen barriers would enable the titanium alloys to be used for longer times at higher temperatures. We have demonstrated that coatings of the MCr and McrAlY-types can be protective to various substrates at temperatures up to about 850° C. These coatings are not as compatible with titanium aluminide substrates as titanium aluminides protective coatings would be. It is thought that at temperatures above about 850° C. it is possible that diffusion of coating elements of the MCrAlY type coatings into the alloy substrates may result in different surface reactions and may cause problems. However, the alloys which are based on the binary, titanium aluminide have a potential for use and high temperature aircraft components as they have low densities as explained more fully above and can have considerable strength and ductilities at temperatures up to about 1000° C. However, it is recognized that many of these alloys are susceptible to oxidation at these higher temperatures.

BRIEF DESCRIPTION OF THE INVENTION

It is accordingly one object of the present invention to provide titanium base alloy compositions having greater resistance to oxidation.

Another object of the present invention is to provide structures for high temperature high strength use such as in aircraft engines with high resistance to oxidation.

Another object is to provide a metal substrate with a titanium base which has oxidation resistance which approaches or surpasses the oxidation resistance of MCrAlY-type protective layers.

Other objects will be in part apparent and in part pointed out in the description which follows.

In one of its broader aspects objects of the present invention can be achieved by providing a gamma titanium aluminide having chromium and tantalum additives according to the expression:

$Ti\text{-}Al_{46\text{-}52}Cr_{1\text{-}4}Ta_{4\text{-}8}$.

A preferred range of ingredients is according to the expression:

$Ti\text{-}Al_{46\text{-}50}Cr_{1\text{-}4}Ta_{5\text{-}7}$.

A more preferred range of ingredients is according to the expression:

$Ti\text{-}Al_{46\text{-}50}Cr_{1\text{-}3}Ta_{6}$.

In these expressions, titanium is the balance except for the inevitable impurities.

BRIEF DESCRIPTION OF THE DRAWINGS

The detailed description of the invention which follows will be understood with greater clarity if reference is made to the accompanying drawings in which.

DETAILED DESCRIPTION OF THE INVENTION

Figure 1:
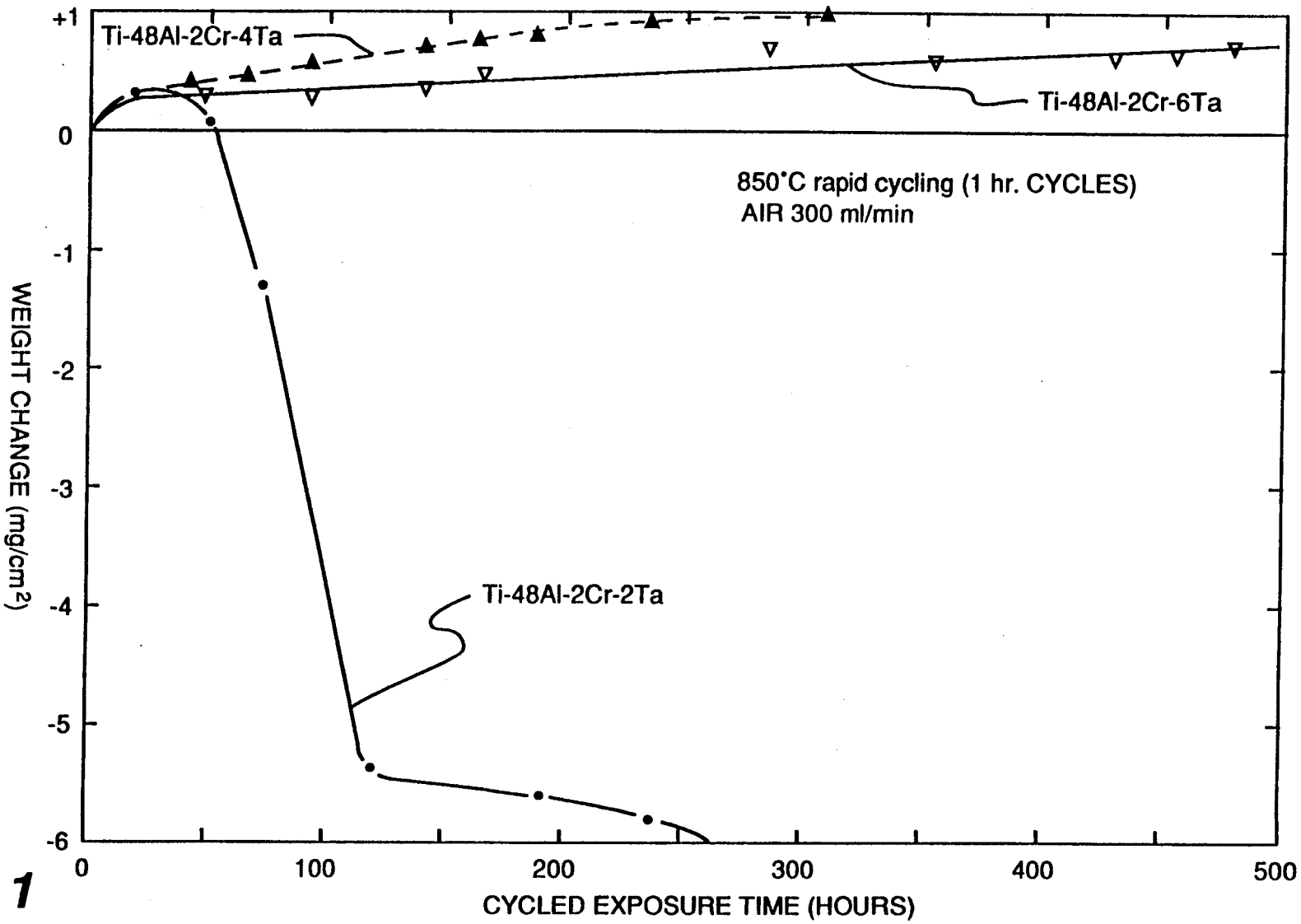
FIG. 1 is a graph in which weight change in milligrams per square centimeter is plotted against the cycled exposure time in hours.

We have made a detailed study of the oxidation behavior of a number of gamma TiAl alloys at temperatures up to 1000° C. In making these studies we have used a rapid thermal cycling technique and test procedure. The rapid cycle testing is a procedure in which the sample is exposed to flowing air at a designated temperature, as for example 850° C. or 1000° C., and the temperature is cycled to the test temperature for 50 minutes and then allowed to cool for 10 minutes. The air flow during such tests is at a rate of 300 milliliters per minute.

In making this series of tests we have found that the oxidation resistance is greatly influenced by the presence of low concentrations of ternary and quaternary elements such as niobium tantalum tungsten, chromium and manganese.

We have found hat when chromium alone is added, the effect on oxidation resistance is deleterious and that the resistance is reduced. We have also found that the oxidation resistance is enhanced by small niobium additions.

When a combination of chromium and niobium is added to a gamma TiAl alloy, as for example Ti-48Al-2Cr-2Nb, alloys are produced which have good physical properties and which are resistant to oxidation to about 850° C. A commonly owned patent. U.S. Pat. No.4,879,092 concerns this alloy composition. We have found that at higher temperatures this composition does produce a spalling oxide scale after an initial induction.

What we have also found to be entirely unique in the range of gamma titanium aluminide alloys having ternary and quaternary additives is a composition containing a small amount of the order of 2 atom percent of chromium and a larger amount of the order of 6 atom percent of tantalum. The oxidation behavior of these alloys is quite unique and is very dependent on the level of the tantalum additive. Extensive studies of this and related compositions have been made and this application for patent is a result of these studies.

In general, we have found that increases in the concentration of the chromium additive result in increases in oxidation resistance but that such increases also result in decrease in ductility. Chromium concentrations of from 1 to 4 atom percent may be used when coupled with tantalum additions of from 4 to 8 atom percent depending on the use application to be made of the alloy.

Similarly with respect to the aluminum ingred:rent, generally the higher the aluminum content of the novel compositions disclosed herein the better the oxidation resistance. However, higher aluminum concentrations can be detrimental to ductility of these compositions.

A principal object of coating end use applications, for example, is to form a coating which has properties the same as or close to those of a titanium aluminide substrate on which the coating is formed. A coating which has a ductility, thermal expansion, or other property or combination of properties close to that of a titanium aluminide substrate, such as Ti-48Al-2Cr-2Nb, for example, is desirable and valuable.

The remarkable novelty and uniqueness of this set of compositions can be best described with reference to the accompanying drawings in which the weight change of an alloy sample is plotted against the time and hours during which the sample was exposed to the cyclic heating at the temperature indicated on the graph.

Referring now first to FIG. 1 a plot of the results of tests of three compositions is set out on the graph. These compositions were tested through one hour heating cycles to 850° C as described above with air flowing at 300 milliliters per minute as indicated in the legend in the figure. The number of cycles of exposure given in time and hours is displayed on the abscissa and the resultant change in weight of the sample is given in milligrams per square centimeter in the ordinate. Zero weight gain is indicated in the ordinate scale and a horizontal line providing a reference value for zero weight gain is marked on the Figure. A sample having the composition Ti-48Al-2Cr-2Ta was tested and as indicated by the marked plot of FIG. 1, first displayed a relatively short weight gain over the first 50 hours of cycle testing and then displayed a very rapid weight loss as the oxide coating spallated and separated from the surface of the sample. The test results ran off the chart at −6 milligrams per square centimeter of sample at about 265 hours of cycle testing.

A sample having a composition Ti-48Al-2Cr-4Ta was tested and this composition displayed a continuing weight gain through about 300 hours of cycle testing with a net gain of about 1 milligram per square centimeter over this period of time. Obviously from the results plotted in FIG. 1, the results obtained with the second composition containing 4 atom percent tantalum represented a remarkable and unique improvement in oxidation resistance when compared to the composition containing 2 atom percent of tantalum.

A third sample having a composition of Ti-48Al-2Cr-6Ta was similarly tested in an hourly cycling test at 850° C. with the flowing air at 300 milliliters per minute. As is evident from the marked plot of FIG. 1, this sample continued to gain weight for the entire 500 hours of the test and the weight gain was less than 1 milligram per square centimeter and was closer to about 75 milligrams per square centimeter.

From the data plotted in FIG. 1 it is accordingly evident that compositions containing 4 atom percent of tantalum or more have a unique and remarkable improvement in resistance to oxidation when compared to the composition having 2 atom percent tantalum or less. The compositions having at least 6 atom percent of tantalum gave the most spectacular oxidation resistance results as is evidence from the plot of FIG. 1. At values of 8 atom percent tantalum and higher, the oxidation resistance is not as favorable as it is for the compositions with less than 8 atom percent tantalum.

Based on these results, we concluded that these compositions can be used as protective coatings on titanium aluminides, as well as on other substrates, which are more susceptible to oxidative attack at elevated temperatures.

Figure 2:
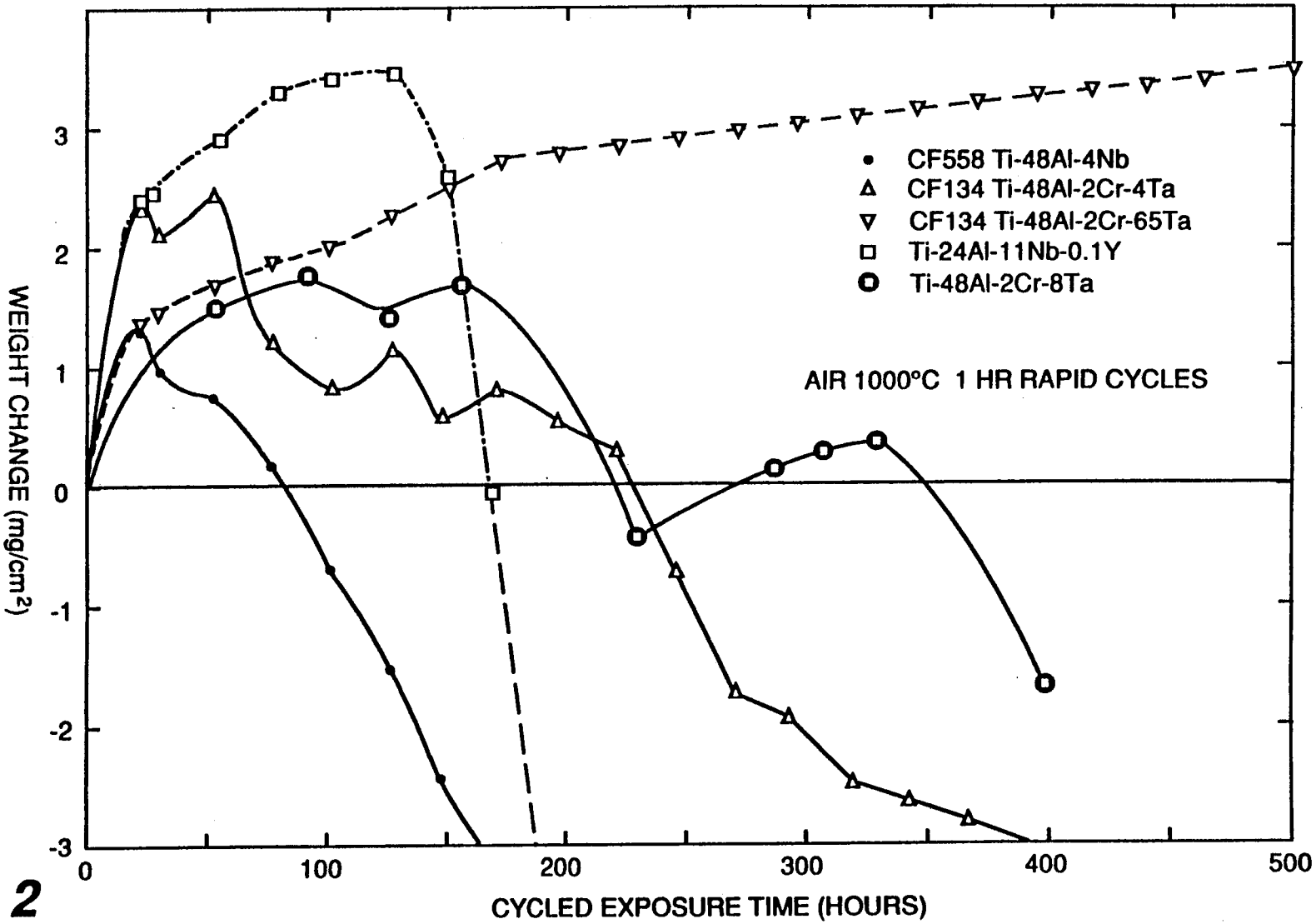
FIGS. 2, 3 and 4 are graphs very similar to the graph of FIG. 1.

Referring next to FIG. 2, a set of data is plotted for tests conducted at 1000.C in flowing air employing the rapid heating cycle regime of the first set of experiments. Weight change is recorded with reference to the line plotted on the figure. The first test was of a sample with a composition Ti-48Al-4Nb. As indicated on the graph, this composition first gained about 1.3 grams per square centimeter in the first 25 hours of testing and then lost weight at a rapid rate with the lost weight results going off the table at about −3 milligrams per square centimeter after about 170 hours of testing.

A second test was performed on a sample having a composition 48Al-2Cr-4Ta and the results of this test are also illustrated in the figure. The initial weight gain of about 2.5 milligrams per square centimeter during the first 70 hours of testing was followed by a decline in weight as the oxide flaked from the surface of the sample and the plot went off the lower scale at about -3 milligrams per square centimeter short of 400 hours of testing. A fourth sample having a composition Ti-24Al-llNb-0.lY was also tested and its fate is also plotted in the graph of FIG. 2. This composition first gained about 3.5 milligrams per square centimeter of sample during the first approximately 135 hours of testing and this gain was followed by an extremely rapid loss of weight with the plot going off the scale at more than 3 milligrams per square centimeter of weight loss at less than 200 hours of testing.

The third sample tested was a sample having a composition Ti-48Al-2Cr-6Ta. As is also evident from the plot this sample continued to gain weight during the entire 500 hour test and the sample had gained approximately 3.6 milligrams per square centimeter of sample after about 500 hours of testing. Accordingly it is evident from the plot of FIG. 2 that the sample having the composition Ti-48Al-2Cr-6Ta was a unique and remarkable sample with reference to oxidation resistance. The fact that the sample continued to gain weight and did not lose weight during the entire 500 hours of cyclic testing at 1000.C indicated that the oxide formed on the sample was not an oxide which spalled and separated from the surface of the sample. It is this characteristic of the oxide which forms on the titanium aluminide sample which contains 2 atom percent of chromium and 6 atom percent of tantalum which makes all the difference in the protective character of the alloy substrate.

A fourth sample had a composition Ti-48Al-2Cr-8Ta. It is evident from the plot of data obtained for this sample that it has oxidation properties less favorable than those for Ti-48Al-2Cr-6Ta but that its oxidation resistance properties are quite high and comparable to those for the composition Ti-48Al-2Cr-4Ta.

Figure 3:
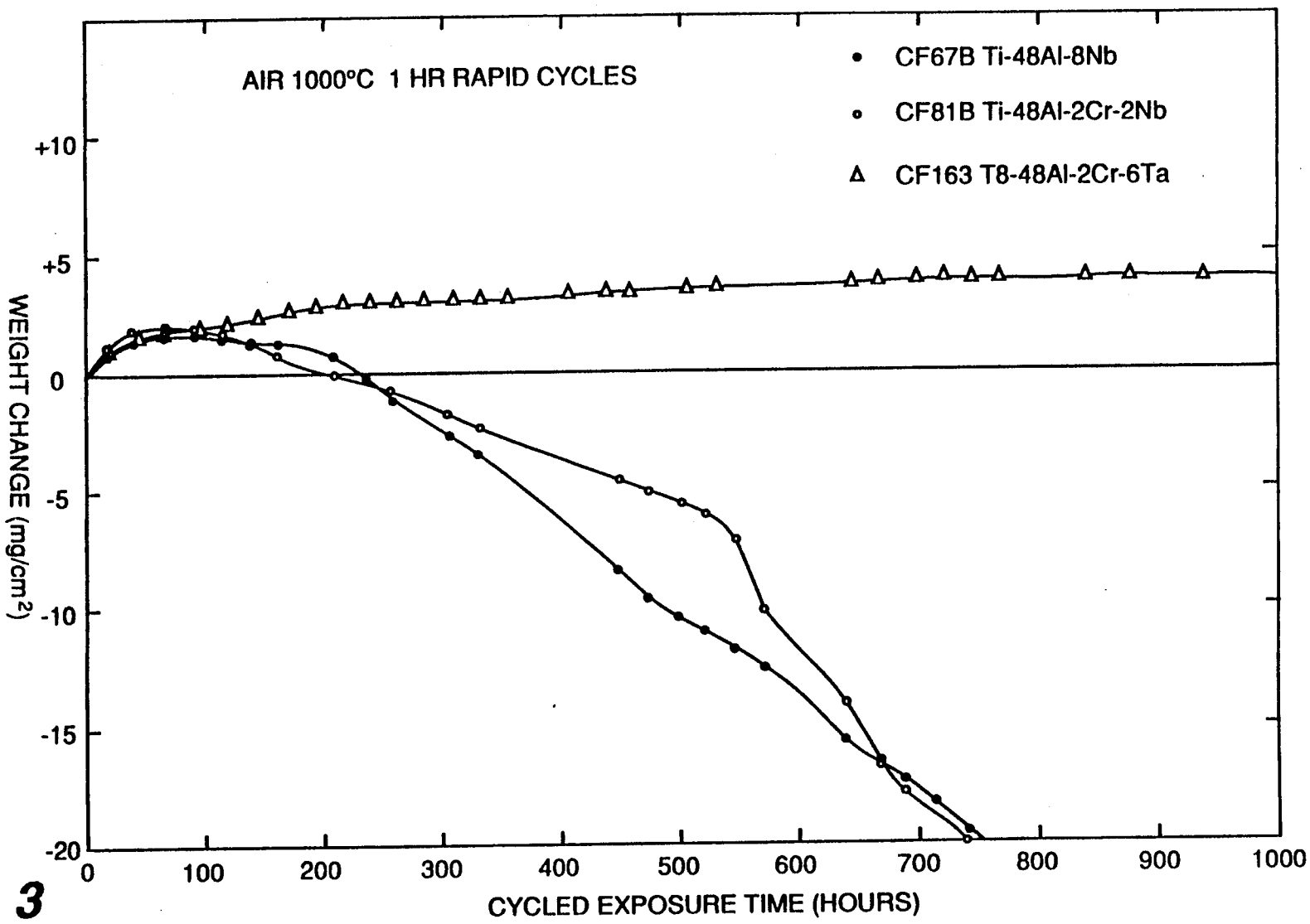

Reference is next made to FIG. 3 and to the plots of the results obtained from testing of three different doped titanium aluminide samples at 1000.C using rapid cycling and flowing air as described above.

The first sample was of an alloy having a composition Ti-48Al-8Nb. This sample was tested through the rapid cycle heating tests and the results obtained are plotted on the figure. The sample first gained about 2 milligrams per square centimeter during the first 200 hours of testing and then continuously lost weight due to spallation until the test ran off the chart at about -20 milligrams per square centimeter at about 760 hours of testing.

The second sample contained the composition Ti-48Al-2Cr-2Nb. The sample also gained about 2 milligrams per centimeter of surface area during the first 100 hours of testing and then lost weight during the next 640 hours of testing to go off the chart at about -20 milligrams per square centimeter.

The sample of one of the compositions of the present invention, containing Si-48Al-2Cr-6Ta, was tested and it also gained about 2 milligrams per square centimeter of sample during the first 100 hours of testing. However, unlike the other two samples, this sample continued to gain and failed to lose weight during the next 900 hours of testing so that the final weight of the sample represented an increase of about 4 milligrams per square centimeter during the entire 1000 hours of testing at 1000 C in flowing air during the rapid cycle heating test. This test was essentially a continuation of the test of the same composition as described with reference to FIG. 2. Again, a remarkable unique and novel resistance to oxidation is displayed by the titanium aluminide composition containing the 2 atom percent chromium and 6 atom percent tantalum.

Figure 4:
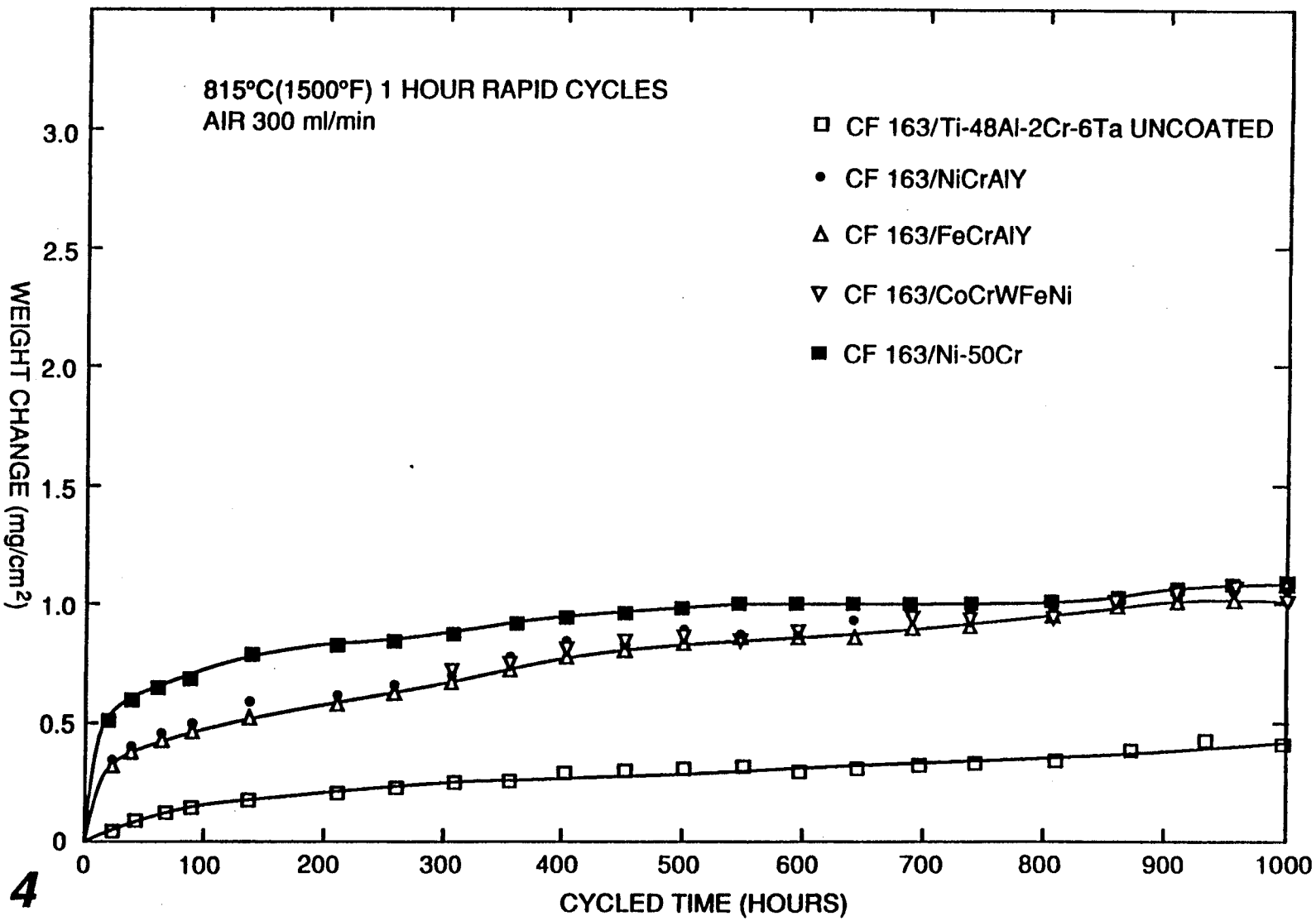
Figure 5:
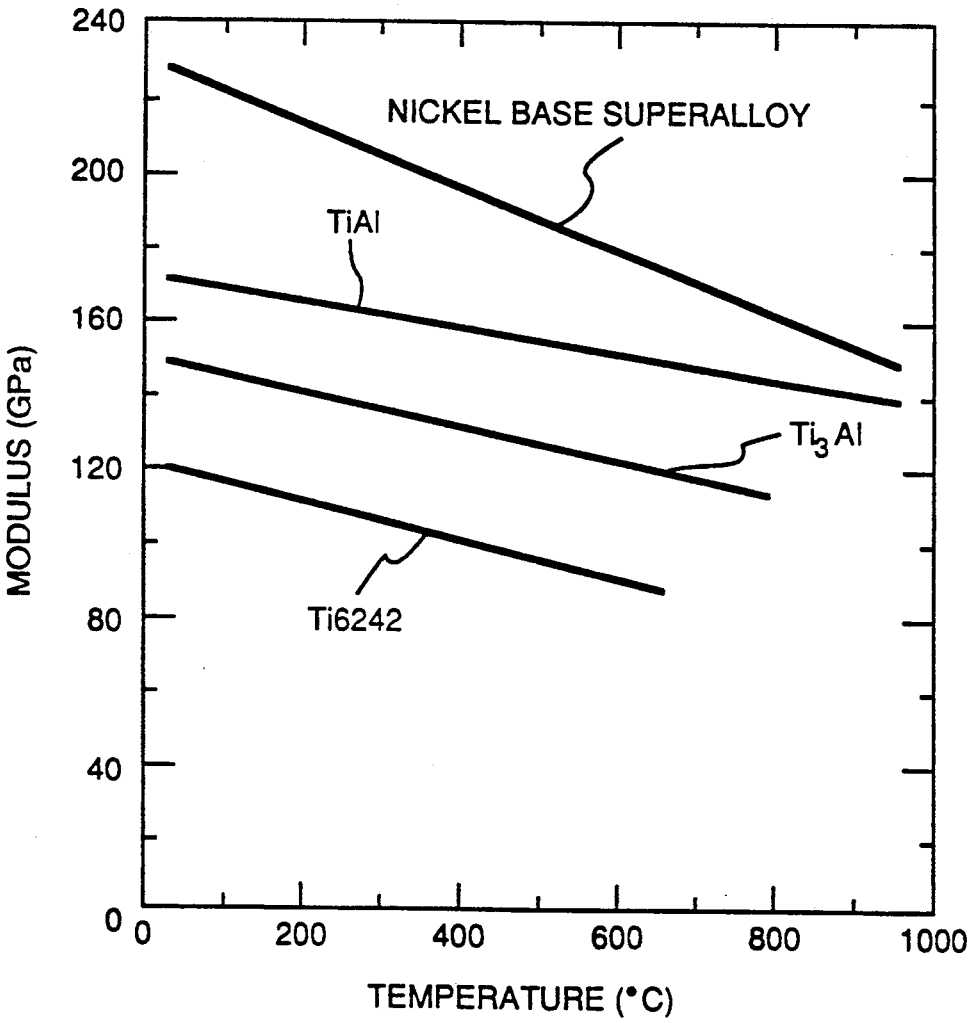
FIG. 5 is a graph illustrating the relationship between modules and temperature for an assortment of alloys.

Referring now next to FIG. 4 an effort was made through the series of tests to compare the oxidation resistance of the uncoated titanium aluminide containing 2 atom percent chromium and 6 atom percent tantalum identified as CF163 in the figure with coatings of a number of other conventional oxidation resistance materials onto a substrate of the Ti-48Al-2Cr-6Ta also identified in the FIG. 4 as CF163.

The first material tested was a NiCrAlY coating on the Ti-48Al-2Cr-6Ta substrate. The composition of NiCrAlY is a well known and well established oxidation resistant coating material employed in coating various substrate materials subjected to higher temperature and high stress. In this particular case, the temperature to which the tested sample was heated was 815° C. using the 1 hour rapid cycle testing method described above. As in all other tests set forth in this application air was flowed over the sample at 300 milliliters per minute. The result of the test is plotted in FIG. 4. The NiCrAlY data is represented by the dots in the intermediate curve between the uppermost and lowermost curves of the plot.

The next coating material tested pursuant to this series of tests was the FeCrAlY coating material represented in the graph by the vertical triangle. As is evident from FIG. 4 the data obtained from this test is plotted essentially along the same intermediate curve path as the NiCrAlY data discussed above.

The next coating sample tested was a CoCrWFeNi coating and the data obtained and plotted for this sample is represented by the inverted triangles. As is evident from FIG. 4 the series of inverted triangles again follows the intermediate curve of the figure. In each of these three tests, the weight gain over the 1000 hours of the test was approximately 1.2 milligrams per square centimeter.

The fourth test of this series was carried out with a coating composition of Ni-50Cr coated onto the CF163 base of Ti-48Al-2Cr-6Ta. The solid square data points plotted for this sample appears as the uppermost of the three plotted curves of FIG. 4. The nickle chromide displayed a weight gain which exceeded that of the 3 samples discussed above. The final level of the weight gain of the sample was not greatly different from that of the other samples and a value of about 1.3 milligrams per square centimeter was observed for this sample after it had completed the 1000 hours of rapid cycle heating.

The next sample tested is represented in the data plotted in FIG. 4 by the open squares. This sample, also identified as CF163, is the sample of the Ti-48Al-2Cr-6Ta material which was an uncoated substrate material. As is evident from FIG. 4, the weight gain for this sample was less than half of the weight gain displayed for the other four samples. The weight gain after 1000 hours of testing at 11° C. employing flowing air at 300 milliliters per minute and the 1 hour rapid cycle heating regimen was approximately 0.4 milligrams per square centimeter.

Accordingly the data plotted for the five test the samples as carried out in this testing series demonstrates that the uncoated gamma titanium aluminide alloy having 48 atom percent aluminum, 2 atom percent chromium and 6 atom percent tantalum performs at a remarkably high level of oxidation resistance for a substrate material. It must be realized that each of the other materials of this series is essentially a coating type of material so that the substrate material of the Ti-48Al-2Cr-6Ta is being compared with coating materials. One of the most critically significant differences between an uncoated substrate material and a coated material is that the substrate material possesses sufficient physical and other properties to permit its use as a structural material per se. This contrasts with substrate materials which are employed as structural materials but must be coated with a coating material such as the NiCrAlY or FeCrAlY materials which have properties suitable for use as coatings but which do not themselves possess adequate physical properties to be employed as structural materials. Accordingly, the novel and unique Ti-48Al-2Cr-6Ta material of the subject invention is unique both in that it has the remarkable oxidation resistance displayed in the four graphs discussed above but is also a material which itself serves as a substrate or which itself can serve as a structural material in the articles to be incorporated within a jet engine.

In addition, because of the unique properties which the Ti-48Al-2Cr-6Ta material displays relative to physical properties and oxidation resistance it is possible to employ this novel and unique material as a coating material. This is particularly true for substrate material such as the gamma titanium aluminides of which this material is a member. Accordingly, we have the situation in which the Ti-48Al-2Cr-6Ta material can be applied to a gamma titanium aluminide as a protective oxidation resistant coating for the gamma titanium aluminide material and this coating can be accomplished by plasma spray deposit or by a number of other means.

An oxidation resistance test performed on a sample of Ti-48Al-2Cr-8Ta provided evidence that the oxidation resistance is not as high as that of the Ti-48Al-2Cr-6Ta. However, the Ti-48Al-2Cr-8Ta material had a very superior oxidation resistance making it suitable for use in many applications, similar to the Ti-48Al-2Cr-4Ta material, in which the extraordinary oxidation resistance of the Ti-48Al Ta material is not needed.

What is claimed is:

1. A composite structural metal article comprising, a metal substrate and a metal protective coating on said substrate, the metal of said article being a titanium aluminide, the coating on said substrate being bonded to and protecting said substrate from oxidative attack at temperatures to 850° C. and higher, and said coating having a composition substantially according to the following expression:

$Ti\text{-}Al_{46\text{-}52}Cr_{1\text{-}4}Ta_{4\text{-}8}$.

2. The article of claim 1, in which the expression is $Ti\text{-}Al_{46\text{-}50}Cr_{1\text{-}4}Ta_{5\text{-}7}$.

3. The article of claim 1, in which the expression is $Ti\text{-}Al_{46\text{-}50}Cr_{1\text{-}3}Ta_{6}$.

4. The article of claim 1, in which the expression is $Ti\text{-}Al_{48}Cr_{2}Ta_{6}$.

* * * * *